US008919910B2

(12) United States Patent
Clevers et al.

(10) Patent No.: US 8,919,910 B2
(45) Date of Patent: Dec. 30, 2014

(54) REPRODUCTION APPARATUS FOR PRINTING ON SHEETS

(71) Applicant: OCE Technologies B.V., Venlo (NL)

(72) Inventors: Ernest J. J. Clevers, Broekhuizenvorst (NL); Albert M. Van Beek, Eindhoven (NL); Johannes H. L. Smeyers, Venlo (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 14/018,769

(22) Filed: Sep. 5, 2013

(65) Prior Publication Data

US 2014/0002533 A1 Jan. 2, 2014

Related U.S. Application Data

(63) Continuation of application No. PCT/EP2012/053876, filed on Mar. 7, 2012.

(30) Foreign Application Priority Data

Mar. 24, 2011 (EP) ..... 11159569

(51) Int. Cl.

| | |
|---|---|
| ***B41J 29/28*** | (2006.01) |
| ***B41J 13/00*** | (2006.01) |
| ***B41J 2/155*** | (2006.01) |
| ***B41J 2/165*** | (2006.01) |

(52) U.S. Cl.

CPC ..... *B41J 13/0009* (2013.01); *B41J 2/155* (2013.01); *B41J 2/165* (2013.01); *B41J 13/0027* (2013.01)

USPC ..... 347/16; 347/4

(58) Field of Classification Search

USPC ..... 347/3, 4, 6, 16

See application file for complete search history.

(56) References Cited

U.S. PATENT DOCUMENTS

| | | | | |
|---|---|---|---|---|
| 4,184,673 | A * | 1/1980 | Weisbach | 271/237 |
| 4,657,239 | A * | 4/1987 | Ikesue et al. | 271/227 |
| 7,562,869 | B2 * | 7/2009 | Mao et al. | 271/221 |
| 7,690,648 | B2 * | 4/2010 | Utsumi et al. | 271/240 |
| 2005/0275684 | A1 | 12/2005 | Yamaguchi et al. | |
| 2009/0060615 | A1 * | 3/2009 | Hosoda | 399/400 |

FOREIGN PATENT DOCUMENTS

JP 11-222334 A 8/1999

* cited by examiner

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

A reproduction apparatus includes a print unit with print elements for ejecting an amount of ink on a plurality of sheets, of which each size in the direction perpendicular to the transport direction of the sheets under the print unit is smaller than the size of the print unit in the same direction, and a displacing mechanism for displacing the sheets in the same direction. The displacement of the displacing mechanism is so extreme that an alignment of a sheet is variable from an alignment of one side of the sheet with one end of the print unit to an alignment of the other side of the sheet with the other end of the print unit. Also a method for application by such a reproduction apparatus is disclosed.

11 Claims, 5 Drawing Sheets

REPRODUCTION APPARATUS FOR PRINTING ON SHEETS

CROSS-REFERENCE TO RELATED APPLICATIONS

This application is a Continuation of International Application No. PCT/EP2012/053876, filed on Mar. 7, 2012, and for which priority is claimed under 35 U.S.C. §120, and which claims priority under 35 U.S.C. §119 to Application No. 11159569.0, filed in Europe on Mar. 24, 2011. The entirety of each of the above-identified applications is expressly incorporated herein by reference.

BACKGROUND OF THE INVENTION

1. Field of the Invention

The present invention relates to a reproduction apparatus comprising a print unit of at least one print unit comprising print elements for ejecting drops of marking material on a plurality of sheets, the print unit having two ends in a first direction perpendicular to a transport direction of the plurality of sheets, a transport mechanism configured to transport the plurality of sheets towards the print unit in the transport direction, a displacing mechanism configured to displace the sheets in the first direction, and a controller configured to control the print unit the transport mechanism and the displacing mechanism.

Hereinafter the term print unit may be used for convenience reasons, but it should be understood that the term print unit can also be a print unit consisting of several print units. Also, the term print unit can also be a print bar of several print units or several page wide arrays.

The present invention also relates to a method for printing on sheets by a reproduction apparatus according to the present invention.

2. Background of the Invention

Reproduction apparatuses are known which are able to print jobs arriving at the reproduction apparatus via a network or an analogue document via a scanner being part of the reproduction apparatus. Such a job may contain an image and/or text in black-and-white format or in color format. The job entry in the reproduction apparatus may be controlled by the control mechanism, for example a computer, a control unit and/or a processor inside the reproduction apparatus. Also the controller may convert image and/or text data into commands for the print unit to let the printing elements eject marking material at the right spot and the right time on sheets. The job may be printed on sheets which are transported along a print unit in the transport direction, for example inkjet printers. Especially the size of the print unit in the transport direction is usually larger than the distance between two succeeding sheets on the transport mechanism. The distance between two succeeding sheets is small in order to achieve a high productivity of the reproduction apparatus.

A print unit may comprise a plurality of page wide arrays which are mutually aligned. Usually, page wide arrays are relatively heavy and connected via many cables and hose pipes for transport of the marking material, like ink, to the page wide arrays.

If the print unit is stationary, for example a plurality of page wide arrays, the sheets may have a small format in comparison with the size of the print unit. Therefore, not all printing elements of the print unit are used to eject marking material on the sheets, since marking material ejected from outmost printing elements would drop on the transport mechanism, e.g. a transport layer of the transport mechanism underneath the sheets, instead of on the sheets. Outmost printing elements are therefore usually not used when printing on sheets of such a small format. This is disadvantageous, since the outmost nozzles may easily become clogged. Clogging is an important failure mechanism in inkjet printers. To prevent nozzles from clogging, they need to eject a drop of marking material from time to time. When a printing element is clogged, a repair action needs to be carried out, which leads to a decrease of the productivity of the reproduction apparatus.

In the case of a small format of sheets, the ejection of drops of marking material from time to time becomes impossible for outmost printing elements or at least for printing elements at one side of the print unit under which no part of each small format sheet will be transported.

SUMMARY OF THE INVENTION

It is an object of the present invention to provide a reproduction apparatus which enables each printing element to eject drops of marking material on sheets independent of the size of a sheet in the first direction.

According to the present invention, this object is achieved by a reproduction apparatus, wherein the displacing mechanism is configured to displace the sheets in the first direction before arriving at the print unit towards such a position that at least one sheet aligns with one of the ends of the print unit and at least one sheet aligns with the other end of the print unit.

Electro-photographical reproduction apparatuses are known, which have displacing mechanisms in order to displace the incoming sheets along the print unit a small amount, for example a few millimeters. This limited displacement is applied in electro-photographical reproduction machines comprising rubber belts over which the sheets are transported. The purpose of the limited displacement in such machines is to avoid wearing of the rubber belt at the spots over which the edges of the sheets are usually moved during transport. However, this kind of limited displacement does not result in using all printing elements for printing on the sheets.

The displacing mechanism according to the present invention is able to displace sheets before they arrive at the print unit. The displacement according to present the invention is so extreme that each print element is able to eject ink on the sheets during printing of the sheets. By doing so, clogging will be prevented, which leads to a higher productivity of the reproduction apparatus and less service calls. Also, an extended life-time of the print unit will be established. Such an extreme displacement of a sheet is realizable because of the relatively light weighted sheets.

According to an embodiment of the reproduction apparatus according to the present invention, the displacing mechanism is configured to alternate the position of the sheets by aligning a first number of at least one sheet with one end of the two ends and a second number of at least one subsequent sheet with the other end of the two ends. During printing of the first number of at least one sheet, printing elements on the one end of the print unit in the first direction are able to eject drops of marking material on a sheet. During printing of the second number of at least one sheet, printing elements on the other end of the print unit in the first direction are able to eject drops of marking material on a sheet.

If the size of the sheets in the first direction is smaller than half the size of the print unit in the first direction, the displacing mechanism may displace sheets in at least one other position in the first direction between the extreme displacement positions mentioned above, in order to also enable printing elements in the middle of the print unit to eject drops of marking material on a sheet. By alternating between the ends of the print unit in the first direction, printing elements near both ends of the print unit are engaged in dropping marking material on the sheets.

According to an embodiment the reproduction apparatus according to the present invention, the displacing mechanism is configured to alternate the position of the sheets between a constant number of subsequent sheets. By doing so, the load of a print unit printing drops of marking material on the sheets is approximately equally distributed along the outmost printing elements. This is advantageous, since the life time of the print unit is extended and also a time interval between routine services for wiping the printing elements is enlarged. The constant number may vary from 1 to any reasonable natural number, for example an average number of sheets in a print job.

According to an embodiment of the reproduction apparatus according to the present invention, the displacing mechanism is configured to alternate the position of the sheets between each pair of subsequent sheets. By doing so, the displacing mechanism alternates the position of the sheets between each sheet and a subsequent sheet.

According to an embodiment of the reproduction apparatus according to the present invention, the displacing mechanism is configured to align the first number of at least one sheet, on which drops of marking material correspond to print data of a print job, with the one end of the print unit and to align the second number of at least one sheet, on which drops of marking material correspond to print data of a subsequent print job, with the other end of the print unit. This is advantageous, since it may be used in combination with an output device that is so large in the direction perpendicular to the transfer direction of the sheets of a print job, that the printed sheets need not be put together any longer. Since the printed sheets of subsequent jobs are already displaced, they are recognizable as output of subsequent print jobs in the finisher.

According to an embodiment of the reproduction apparatus according to the present invention, the displacing mechanism is configured to align a set of a print job to be printed on the first number of at least one sheet with the one end of the print unit and to align a subsequent set of the print job to be printed on the second number of at least one sheet with the other end of the print unit. This is advantageous in the case that a print job comprises a plurality of sets which have to be output to a finisher in a staggered way. The displacing of the subsequent sets is an opportunity to stagger the sets in the same way as the displacement has already indicated.

According to an embodiment of the reproduction apparatus according to the present invention, a second displacing mechanism is configured to displace the sheets after being printed upon towards a single position perpendicular to the transport direction before the sheets leave the reproduction apparatus. This is advantageous, since the sheets end up in a neat pile of sheets having the same size as the sheets.

According to an embodiment of the reproduction apparatus according to the present invention, the sheets are positioned on the perpendicular bisector of the size of the print unit in the first direction. This is advantageous, since the displacement toward one end of the print unit is the same as the displacement toward the other end of the print unit. Moreover, the maximum displacement is minimized in both directions such that displacement requirements for the displacing mechanism are not as severe as in the case of asymmetrical displacements.

According to an embodiment of the reproduction apparatus according to the present invention, one sheet has a size in the first direction that is smaller than the size of the print unit in the first direction. Since the size of such a sheet is smaller than the size of the print unit in the first direction, the displacement of the small sheet from an alignment with one end of the print unit to an alignment with the other end of the print unit, is substantial and necessary to let all printing elements be able to eject drops on the small sheet.

The present also relates to a method in a reproduction apparatus comprising a print unit consisting of a plurality of print units each of which comprises print elements for ejecting an amount of ink on a plurality of sheets, of which each size in a first direction perpendicular to the transport direction of the sheets is smaller than the size of the print unit in the same first direction, and a displacing mechanism configured to displace the sheets in the first direction, wherein the displacement of the displacing mechanism is so extreme that an alignment of a sheet in the first direction is variable from an alignment of one side of the sheet with one end of the print unit in the first direction to an alignment of the other side of the sheet in the first direction with the other end of the print unit in the first direction.

The present invention is also directed to a computer program embodied on a non-transitory computer readable medium comprising computer program code to enable a reproduction apparatus according to the present invention to execute the method according to any one of the embodiments described hereinabove.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
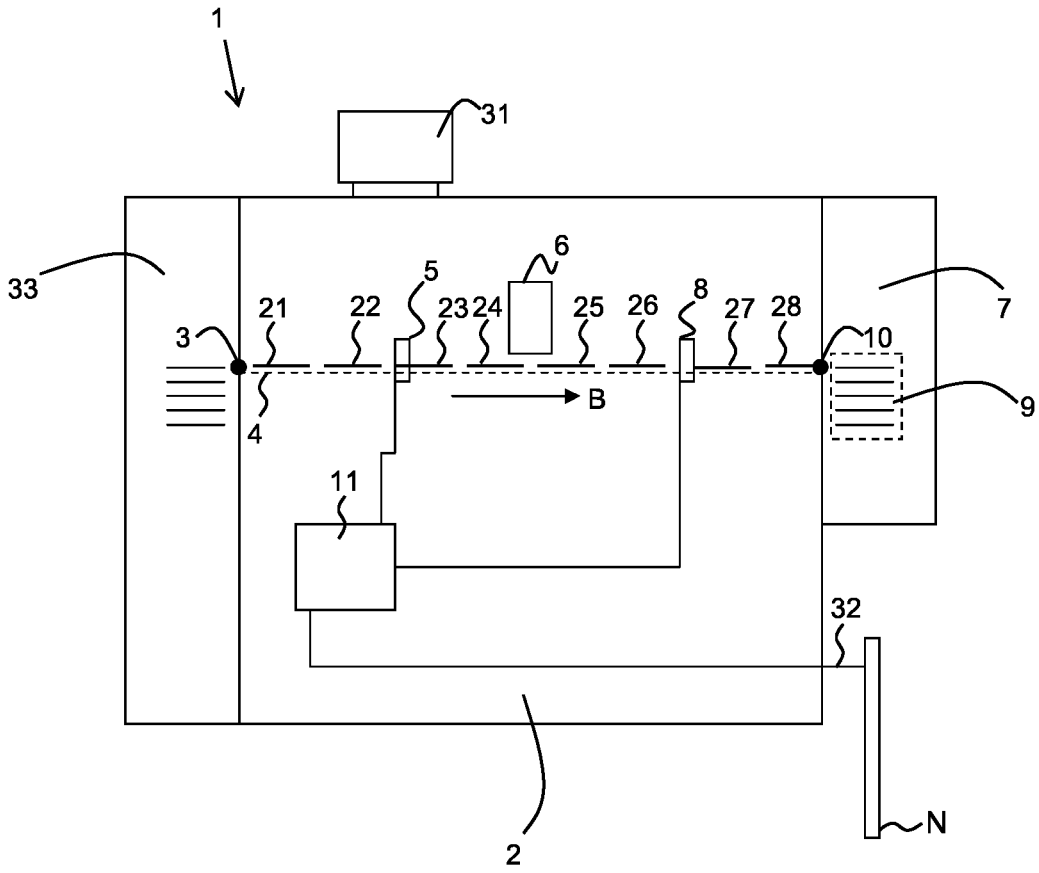
FIG. 1 is a schematic view of a reproduction apparatus to which the present invention is applicable.

The present invention will now be described with reference to the accompanying drawings, wherein the same or similar elements are identified with the same reference numeral.

FIG. 1 shows a reproduction apparatus 1, wherein printing is achieved using a cut sheet printer 2 with a print unit 6 having a size in the first direction A (not shown in FIG. 1) and a size in the transport direction B perpendicular to a first direction A. Small sheets 21-28 are transportable in the transport direction B. The reproduction apparatus 1 furthermore comprises a mechanism configured to receive print jobs and optionally a mechanism configured to manipulate print jobs.

These mechanisms may be a digital input device such as a user interface unit 31 and/or a control unit 11, for example a computer placed inside the cut sheet printer 2. These mechanisms may also be an analogue input device for input of analogue originals to be copied. The control unit 11 may also be placed in the neighborhood of the reproduction apparatus 1 being connected via a network cable or wireless connection.

The local user interface unit 31 is integrated to the reproduction apparatus 1 and may comprise a display unit and a control panel. Alternatively, the control panel may be integrated in the display unit, for example in the form of a touch-screen control panel. The local user interface unit 31 is connected to the control unit 11.

The control unit 11, for example a computer, comprises a processor adapted to issue commands to the cut sheet printer, for example for controlling the print process. The reproduction apparatus 1 may optionally be connected to a network N. The connection to the network N is diagrammatically shown in the form of a cable 32, but nevertheless, the connection could be wireless. The reproduction apparatus 1 may receive printing jobs via the network. Further, optionally, the control unit 11 may be provided with a USB port, so printing jobs may be sent to the reproduction apparatus 1 via this USB port.

The sheets 21-28 may enter the reproduction apparatus via an entry 3, to which an input unit 33 may be coupled. The input unit 33 may be any compatible paper input module that is able to feed one sheet at a time to the cut sheet printer 2. The reproduction apparatus 1 may also comprise a built-in input unit, for example a tray or a plurality of trays, for receiving sheets from outside the reproduction apparatus 1. An operator may fill these trays from outside the reproduction apparatus 1 or sheets arrive from another device at the entry 3.

The sheets 21-28 may also be larger than the width of the print unit 6. The sheets 21-28 cannot be completely printed upon, which is sometimes not needed, for example in case of edges which have to be cut off, and do not need to be displaced at all.

Via a transport mechanism 4, indicated with a dashed line, the sheets 21-28 arrive at a first displacing mechanism 5 along the perpendicular bisector of the length of the print unit in the first direction A. The sheets 21-28 may arrive along any other line in the second direction B under the condition that every spot on a sheet is reachable by a printing element of the print unit 6 when the sheets are transported underneath the print unit 6. The first displacing mechanism 5 is able to displace the sheets 21-28, in particular when they are smaller in the first direction A than the length C of the print unit 6. Actually, the sheets 21-28 are supposed to be smaller than the length of the print unit 6 in the first direction A.

The first displacing mechanism 5 may be any sheet displacement module which is commonly used in the printing industry. One possible incarnation of such a module uses a set of transport rolls that transport the sheets in the second direction B. The transport rollers as a whole are displaceable in the first direction A while transporting the sheets. This movement causes a displacement of the sheets in the first direction A. This movement is also called "jittering". When displaced, the sheets 21-28 are transported towards the print unit 6.

Figure 2A:
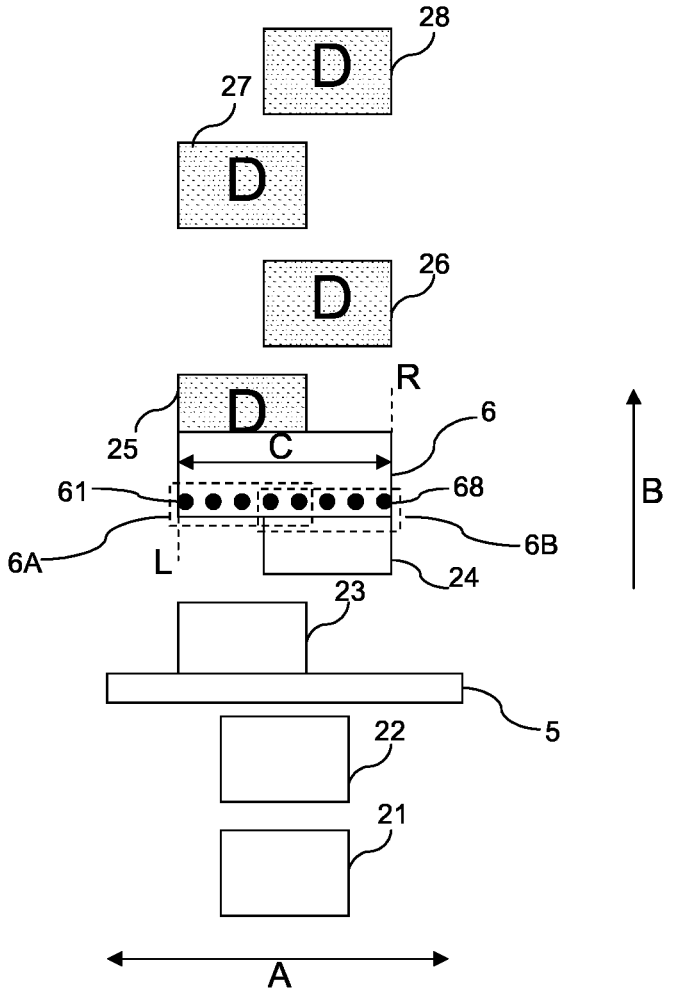
FIGS. 2*a* and 2*b* are a schematic top views of the marking material path in the reproduction apparatus of FIG. 1.

FIG. 2*a* is a schematic top view of the inside of the reproduction apparatus between the entry point 3 and the exit point 10. In FIG. 2, a first sheet 21 and a second sheet 22 are arriving at the first displacing mechanism 5. Further on in the transport direction B, a third sheet 23 is displaced parallel to the left end L of the print unit 6, while a preceding fourth sheet 24 is displaced parallel to the right end R of the print unit 6 and already beneath the print unit 6 ready to be printed upon. The print unit 6 comprises from the left to the right printing elements 61-68. For convenience reasons, eight printing elements are illustrated. In practice, however, the amount of printing elements on the print unit may be quite larger. As shown in FIG. 2*a*, a first part 6A consisting of left outermost printing elements 61-65 are able to eject marking material on the third sheet 23 while a second part 6B consisting of right outermost printing elements 64-68 are able to eject marking material on the preceding fourth sheet 24. In this way, all printing elements 61-68 are actually ejecting marking material on the small sheets 21-28.

Figure 2B:
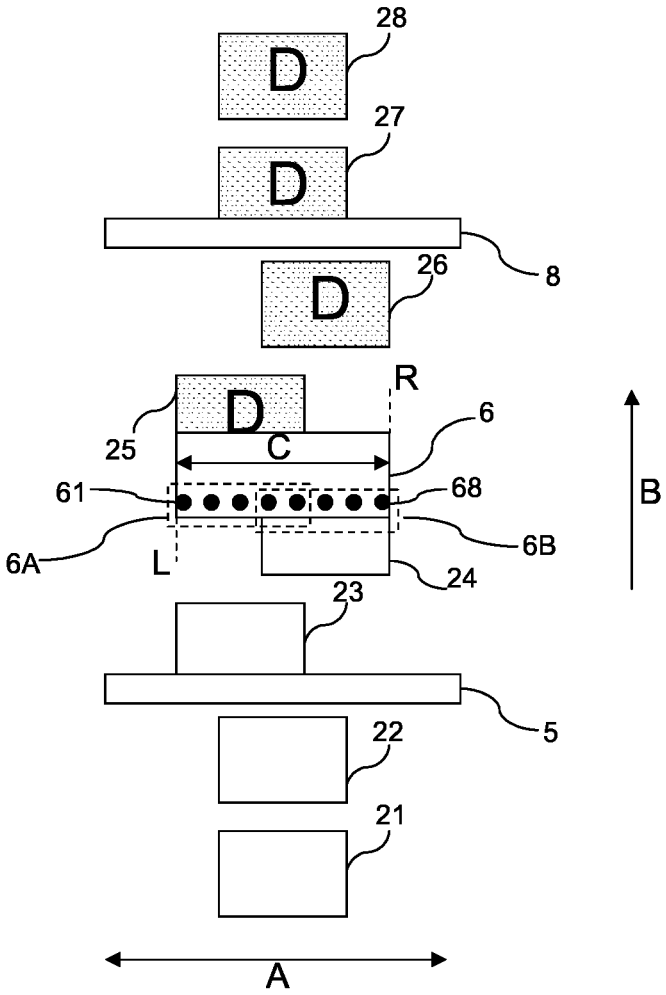

In another embodiment of the reproduction apparatus as shown in FIG. 2*b*, a sheet such as a sixth sheet 26, which has passed the print unit, is transported to a second displacing mechanism 8. The second displacing mechanism 8 is positioned between the print unit 6 and an exit 10 of the reproduction apparatus 1 in order to displace the displaced sheets 21-28 towards a single position with respect to the first direction A before they arrive at the exit 10. In FIG. 2*b*, a seventh sheet 27 and an eighth sheet 28 are displaced by the second displacing mechanism 8 to a position corresponding to the middle of the print unit in the first direction A. The displacement may be to any position reachable by the second displacing mechanism 8, for example the middle, the left side or the right side of the first displacing mechanism, the middle, the left side or the right side of the print unit or the middle, the left side or the right side of the second displacing mechanism.

An output device 7 may be connected to exit 10 for further finishing of the sheets. After displacement by the second displacing mechanism 8, the sheets 21-28 arrive via the exit 10 in the output device 7 in order to create a neat pile 9 of sheets in the output device 7 with the same width in the first direction A as the size of the sheets 21-28 in the first direction A.

In another embodiment the second displacing mechanism 8 is not part of the reproduction apparatus 1, but is comprised in the output device 7. Moreover, if the sheets should be output in a displaced way to the operator wishes, the second displacing mechanism 8 may not be invoked or not present at all.

The control unit 11 is connected to the first displacing mechanism 5, the print unit 6 (not shown in FIG. 1) and, if present, the second displacing mechanism 8.

The control unit 11 is connected to the first displacing mechanism 5 in order to determine which sheets should be displaced to a left position corresponding to the left end L of the print unit 6 and which sheets should be displaced to a right position corresponding to the right end R of the print unit 6.

The control unit 11 is connected to the print unit 6 in order to assign printing elements 61-68 to pixels of the image data, scheduling in time the ejection of marking material from the assigned printing elements. The assigning and scheduling process takes into account the position of each sheet. This is necessary since the sheets 21-28 are displaced when they arrive at the printing elements of the print unit 6.

The control unit 11 is connected to the second displacing mechanism 8 according to FIG. 2*b* in order to determine how the sheets 21-28, which are displaced to the left end L and the right end R, are going to be displaced after passing the print unit 6 towards a single position with respect to the first direction A.

FIG. 1 shows displacement in an alternating way. Variations in the way of displacement of the sheets are allowed as long as the outermost printing elements are ejecting marking material from time to time. This is in particular needed when subsequent print jobs arrive at the reproduction apparatus which need long batches of small sheets to be printed upon.

According to an embodiment, print data of a first print job of such subsequent print jobs is printed on a first number of sheets, which are displaced to one end of the print unit and print data of a subsequent print job of such subsequent print jobs is printed on a second number of sheets, which are displaced to the other end of the print unit.

According to an embodiment, the change of direction of the displacement by the first displacing mechanism is based on a predetermined number of sheets printed in one position of the displacement. This works well if the image data on the sheets is the same. In practice, a print job may require a large number of print sets of the same print data.

According to an embodiment, print data of a print set of a print job comprising a plurality of print sets of the same print data is printed on a first number of sheets displaced in one direction and a subsequent print set of the print job is printed on a second number of sheets displaced in the other direction.

Figure 3:
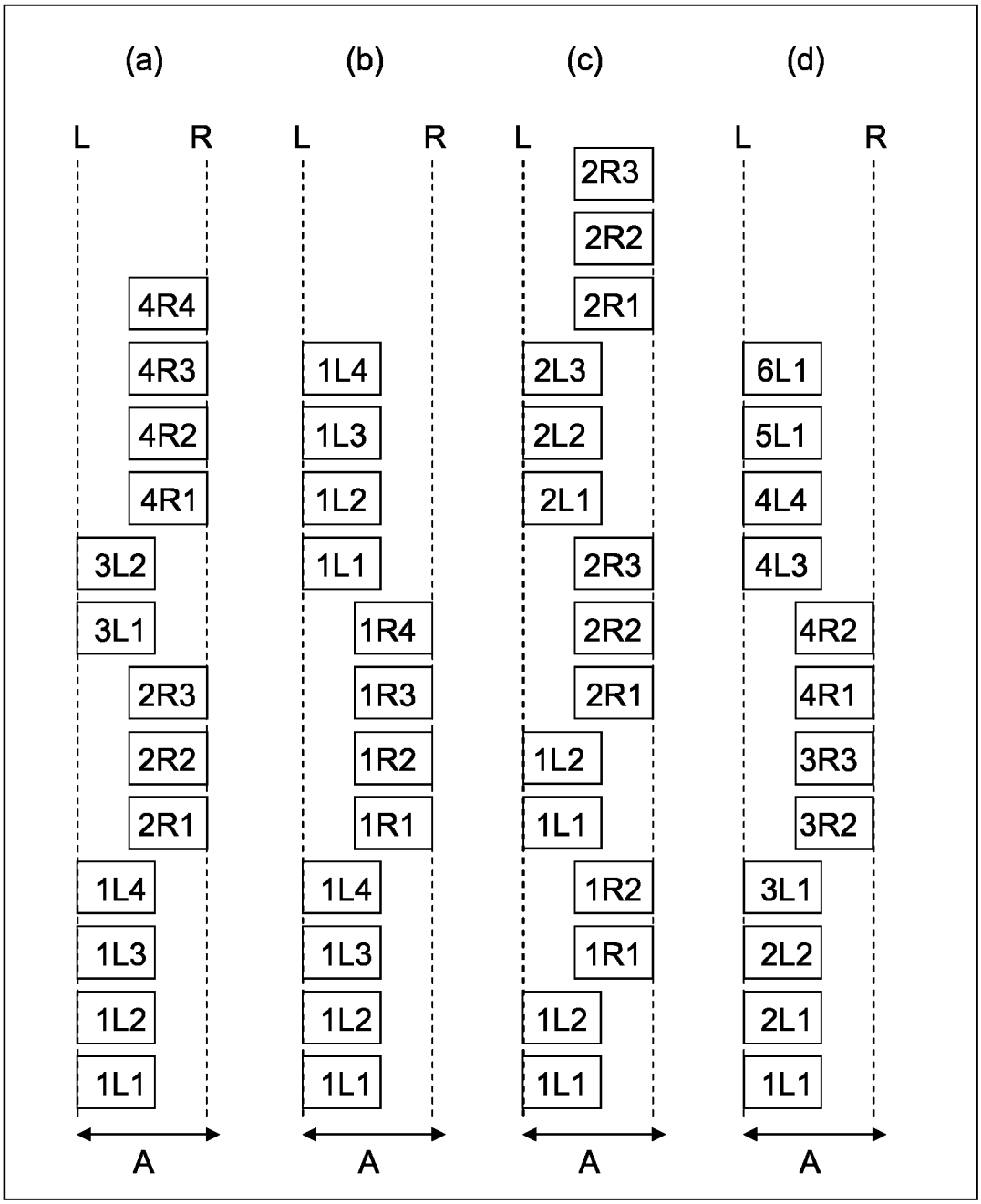
FIGS. 3*a* to 3*d* schematically show a number of aligning strategies.

In general, every possible displacement strategy by the first displacing mechanism may be applied as long as any nozzle of the print unit 6 is able from time to time to eject drops on the receiving material. Embodiments of displacement strategies by the first displacing mechanism are shown in FIG. 3.

In each of the sheets shown in FIGS. 3*a*-3*d*, a combination of a first number, a character L, R, and a second number is placed. The first number is the number of the print job. The character L, R indicates the displacement direction of the sheet. The second number is the sequence number of the sheet in the print job.

In FIG. 3*a*, a change of displacement direction takes place per print job. In FIG. 3*b* a change of displacement direction takes place per set of a print job with multiple sets. In FIG. 3*c*, a change of displacement direction takes place per print job and per set of the print job. In FIG. 3*d*, a change of displacement direction takes place after a predetermined number of sheets independent of the print job or the number of sets of the print job.

According to an embodiment, a change of direction by the first displacing mechanism is controlled by the controller, being dependent on the image data of the print jobs.

The first displacing mechanism may displace sheets in one direction when the printing elements on the one end of the print unit are assigned to eject marking material and the first displacing mechanism may displace in the other direction when the printing elements on the other end of the print unit are assigned to eject marking material.

According to an embodiment, a change of direction of the first displacing mechanism is controlled by the controller, being dependent on a maximum time interval that is required for a printing element to eject printing material in order to avoid clogging of the printing element. Such a time interval may be established beforehand by experiment at the reproduction apparatus.

Figure 4:
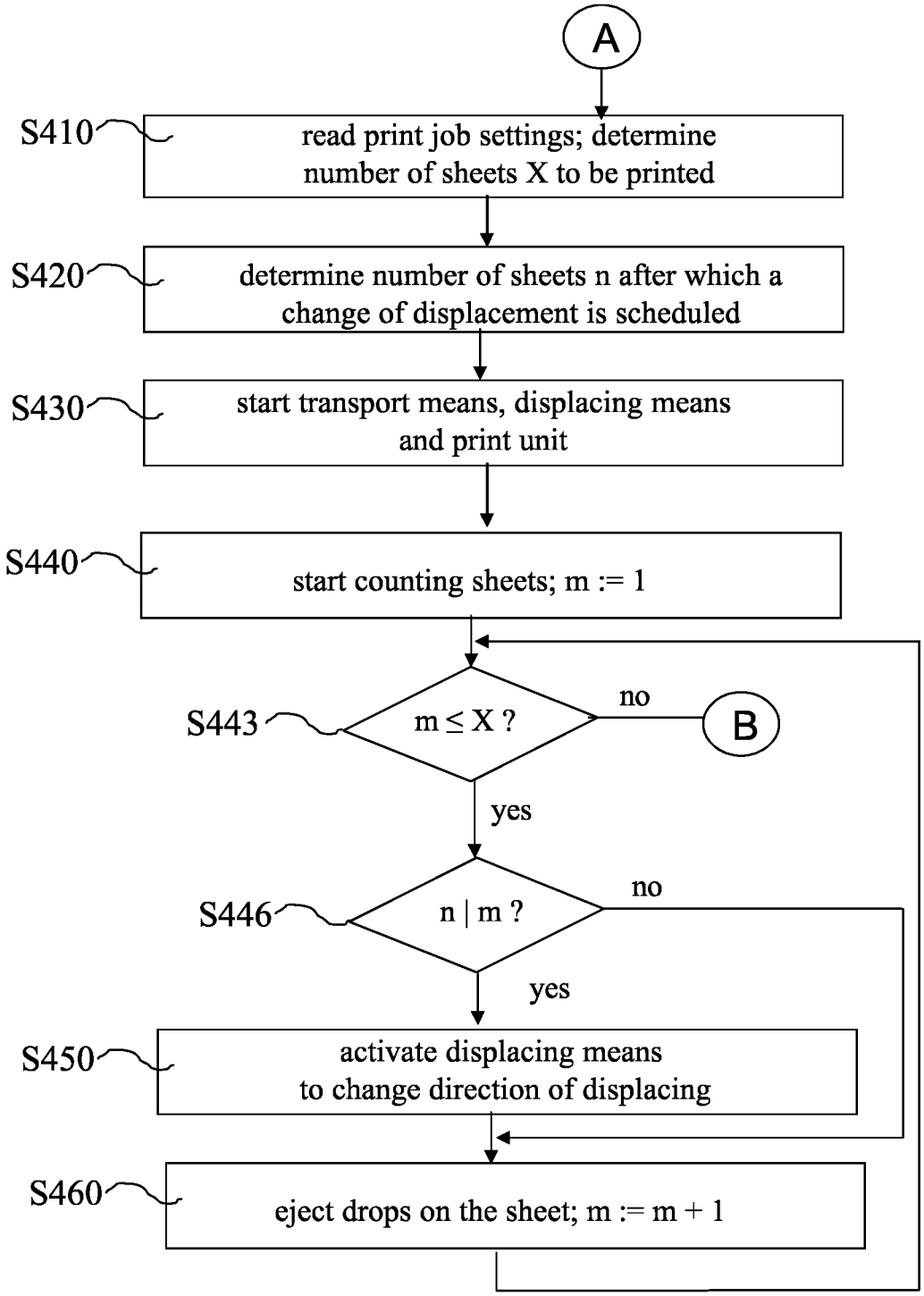
FIG. 4 schematically shows a flow diagram of a method for printing sheets on a reproduction apparatus according to the present invention.

FIG. 4 schematically shows a flow diagram of a method for printing sheets on a reproduction apparatus according to the present invention. The method is described in a plurality of steps S410-S460 for one print job, which has arrived digitally at the reproduction apparatus, but may also be applied for a plurality of subsequent print jobs by repeating the plurality of steps S410-S460. This is one embodiment of the method, but variations may be applied according to the several embodiments of the reproduction apparatus.

Starting point A is the beginning of a print job arriving at the reproduction apparatus.

In a first step S410, the print job settings of the job are read by the control unit of the reproduction apparatus. The number of copies is established and printing should be single-sided or double-sided. Also, other settings which play a role in the printing process are determined. From the complete print job, the total number of sheets X which have to be printed may be derived.

In a second step S420, a number of sheets n is determined after which a change of displacement is scheduled. The number n may depend on the dry time of the printing elements, on the total number of sheets X, on the number of sheets per set of the print job, if the print job has a number of copies greater than one, on the time elapsed since the last change of displacement. By the change of displacement is meant that, when the displacement was before the change to align the sheets with one end of the print unit in the first direction, after the change the sheets are aligned with the other end of the print unit in the first direction.

In a third step S430, the transport mechanism for transporting the sheets towards the print unit is started, and the displacing mechanism and the printing unit are activated by the control unit.

In a fourth step S440, the counting of the sheets which have arrived at the printing unit is started. This may be achieved by a sensor before the printing unit, which activates a count register in a memory part of the control unit or any other suitable way. Initially the count register is set to a value m which is 1.

In a first decision step S443, it is checked if the counter m of the counting sheets exceeds the total number of sheets X. If so, the print job is ready and the method arrived at the end point B. One may proceed with a next print job.

In a second decision S446, it is checked if the counter m is divisible by n. If so, in a next step S450 the displacing mechanism is activated to change direction of displacement. If not, this next step S450 is skipped.

In a next step S460, the current sheet is actually printed by ejecting drops of printing material on the sheet. The counter m is also incremented by 1. Then, the method returns to the first decision step S443.

The method may be generalized by printing a plurality of print jobs and let the number n of sheets determining the change of direction of the displacement the same for each print job and let the counter count all sheets to be printed. The direction is then changed after each n number of sheets independent of a print job change, which may happen between the direction changes. In a first example, two print jobs with 7 and 8 sheets respectively have to be printed, and the number of sheets determined the change of direction is 5. The first 5 sheets of the first print job are aligned with one end of the print unit. The last 2 sheets of the first print job and the first 3 sheets of the second print job are aligned with the other end of the print unit. The last 5 sheets of the second print job are aligned with the one end of the print unit. In a second example, four print jobs with 1, 2, 2 and 2 sheets respectively have to be printed, and the number of sheets determined the change of direction is 5. The sheets of the first, second and third print job are all aligned with one end of the print unit. After the 5 sheets of the first three print jobs have been printed, the 2 sheets of the fourth print job are aligned with the other end of the print unit.

The determined number of sheets n as described hereinabove, is one embodiment of the displacement criterion. However the invention is not limited to this embodiment, but in practice any suitable displacement criterion for determining the displacement of the print unit may be used and implemented in control software and/or hardware in the controller.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A reproduction apparatus, comprising:

a print unit comprising print elements for ejecting drops of marking material on a plurality of sheets, the print unit having two ends in a first direction perpendicular to a transport direction of the plurality of sheets;

a transport mechanism configured to transport the plurality of sheets towards the print unit in the transport direction;

a displacing mechanism configured to displace the plurality of sheets in the first direction; and a controller configured to control the print unit, the transport mechanism and the displacing mechanism, wherein the displacing mechanism is configured to displace the plurality of sheets in the first direction before arriving at the print unit towards such a position that at least one of the plurality of sheets aligns with one of the ends of the print unit and at least one of the plurality of sheets aligns with the other end of the print unit, and wherein the displacing mechanism is configured to alternate the position of the plurality of sheets by aligning a first number of at least one sheet with the one end of the print unit and a second number of at least one subsequent sheet with the other end of the print unit.

2. The reproduction apparatus according to claim 1, wherein the displacing mechanism is configured to alternate the position of the sheets between a constant number of subsequent sheets.

3. The reproduction apparatus according to claim 2, wherein the displacing mechanism is configured to alternate the position of the sheets between each pair of subsequent sheets.

4. The reproduction apparatus according to claim 1, wherein the displacing mechanism is configured to align the first number of at least one sheet on which drops of marking material correspond to print data of a print job with the one end of the print unit and to align the second number of at least one sheet on which drops of marking material correspond to print data of a subsequent print job with the other end of the print unit.

5. The reproduction apparatus according to claim 1, wherein the displacing mechanism is configured to align a set of a print job to be printed on the first number of at least one sheet with the one end of the print unit and to align a subsequent set of the print job to be printed on the second number of at least one sheet with the other end of the print unit.

6. The reproduction apparatus according to claim 1, further comprising a second displacing mechanism configured to displace the displaced sheets after being printed upon by the print unit towards a single position before the sheets leave the reproduction apparatus.

7. The reproduction apparatus according to claim 1, wherein the sheets are positioned on a perpendicular bisector of the size of the print unit in the first direction before arriving at the print unit.

8. The reproduction apparatus according to claim 1, wherein at least one sheet has a size in the first direction, which is smaller than the size of the print unit in the first direction.

9. The reproduction apparatus according to claim 1, wherein a change of direction by the first displacing mechanism is controlled by the controller depending on the image data of the print jobs to be printed on the plurality of sheets.

10. The reproduction apparatus according to claim 1, wherein a change of direction of the first displacing mechanism is controlled by the controller depending on a maximum time interval that is required for a printing element to eject printing material in order to avoid clogging of the printing element.

11. A method for printing sheets of at least one print job on a reproduction apparatus, the reproduction apparatus comprising:

a print unit comprising print elements for ejecting drops of marking material on a plurality of sheets, the print unit having two ends in a first direction perpendicular to a transport direction of the plurality of sheets;

a transport mechanism configured to transport the plurality of sheets towards the print unit in the transport direction a displacing mechanism configured to displace the plurality of sheets in the first direction; and a controller configured to control the print unit, the transport mechanism and the displacing mechanism, the method comprising the steps of:

a) reading settings of the print job by the controller;

b) determining per the at least one print job a number of sheets (X) to be printed;

c) starting the transport mechanism, the displacing mechanism and the print unit;

and, for each print job:

d) determining a number of sheets (n) after which a change of displacement is to be scheduled by the control mechanism;

e) defining and initializing a counter (m) for counting a number of printed sheets of the print job;

f) checking if the counter (m) exceeds the number of sheets (X), and if so, proceeding with the next print job at step d), if any;

g) checking if the counter agrees with a displacement criterion for determining of the displacement of the displacing mechanism, and if so, activating the displacing mechanism to change the direction of displacement; and h) printing the current sheet and incrementing the counter, and proceeding with step f).

* * * * *